United States Patent [19]

Evans et al.

[11] Patent Number: 4,984,127

[45] Date of Patent: Jan. 8, 1991

[54] CONTROL SYSTEM FOR PRECISION SPINAL ADJUSTMENT

[75] Inventors: Joseph M. Evans, Export; E. Rex Moore; James B. Sullivan, both of Pittsburgh, all of Pa.

[73] Assignee: Kinetic Technology, Inc., Greensburg, Pa.

[21] Appl. No.: 333,019

[22] Filed: Apr. 4, 1989

[51] Int. Cl.[5] ..... A61F 5/00

[52] U.S. Cl. ..... 361/179; 128/69; 364/558

[58] Field of Search ..... 364/413.01, 413.02, 364/413.03, 558; 128/54, 69; 340/635; 361/157, 170, 179

[56] References Cited

U.S. PATENT DOCUMENTS

| | | | |
|---|---|---|---|
| 3,612,966 | 10/1971 | Dybel | 361/170 |
| 3,665,945 | 5/1972 | Ottenstein | 364/558 |
| 4,116,235 | 9/1978 | Fuhr et al. | 128/69 |
| 4,461,286 | 7/1984 | Sweat | 128/69 |
| 4,591,944 | 5/1986 | Grauel | 361/170 |
| 4,669,454 | 6/1987 | Shamos | 128/69 |
| 4,716,890 | 1/1988 | Bichel | 128/69 |
| 4,841,955 | 6/1989 | Evans et al. | 128/55 |

*Primary Examiner*—A. D. Pellinen

*Attorney, Agent, or Firm*—Fleit, Jacobson, Cohn, Price, Holman & Stern

[57] ABSTRACT

A control system for a chiropractic adjustment instrument comprising a microprocessor programmable to control various parameters of an adjustor head to be driven against the spinal vertebrate of a patient. A solenoid is associated with the adjustor head which is energized by a capacitor. The capacitor is charged by a charging circuit to the programmed voltage level. The pressure of the adjustor head against the patient is sensed and when the pressure reaches a predetermined level, the capacitor is discharged to the solenoid to drive the adjustor head against the spinal vertebrate of the patient.

13 Claims, 4 Drawing Sheets

CONTROL SYSTEM FOR PRECISION SPINAL ADJUSTMENT

BACKGROUND OF THE INVENTION

Field of the Invention

The general field of this invention is chiropractic adjustment.

Chiropractic adjustment of the spinal vertebrate is commonly made with the use of pressure applied directly to the body with the hands or with the use of a mechanical device. See, for example, U.S. Pat. No. 4,116,235, which discloses a mechanical device for this purpose and discusses in some detail the technique of applying force by application of a thumb thrust.

The force supplied to the patient may vary widely if applied manually or with an instrument. In particular, the energy transmitted to the patient with an instrument depends upon the pressure applied to the patient's body by the instrument under control of the operator. If the contact pressure of the instrument is very low, then very little energy is transferred to the patient. However, as the contact pressure with the patient's bone structure is increased, the energy transferred to the patient increases. This variation in energy constitutes a major problem in obtaining desirable reproducible results. The manually operated units present special difficulties since the operator must typically store energy in an actuator spring by squeezing two projections, while attempting to maintain a constant pressure against the patient.

The primary objective of instrument adjustment is to obtain a desired treatment with the least possible energy transfer to the patient. Instrument adjustment theoretically allows for the precise alignment of force vectors and the application of reproducible minimum force for the required effect. The primary drawback of currently available instruments for spinal adjustment is that the force adjustment mechanisms are crude and vary from instrument to instrument. Usually, no provision is made for varying the energy output of the system when triggering the activator which impacts the adjuster head against the patient. Rather, the releasing mechanism in the prior art devices releases the activator from approximately the same point each time. This causes the energy in the system to be somewhat fixed regardless of what adjustments are made. Additionally, the initial contact force between the activator and patient is solely determined by the force exerted by the operator and therefore may vary over a wide range.

SUMMARY OF THE INVENTION

To overcome the above problems, the present invention provides an apparatus and method for obtaining precise and reproducible energy settings which may be selectively varied over a wide range by an operator.

An object of the present invention is to provide electrical control system which measures the pressure of an adjustment head against the body of a patient and controls the energy available for delivering an impulse adjustment via the adjustment head when the pressure between the adjustment head and the patient reaches a predetermined value.

These and other objects and advantages will become subsequently apparent when reference is made to the following description taken in conjunction with the accompanying drawings.

DESCRIPTION OF THE PREFERRED EMBODIMENT

Figure 1:
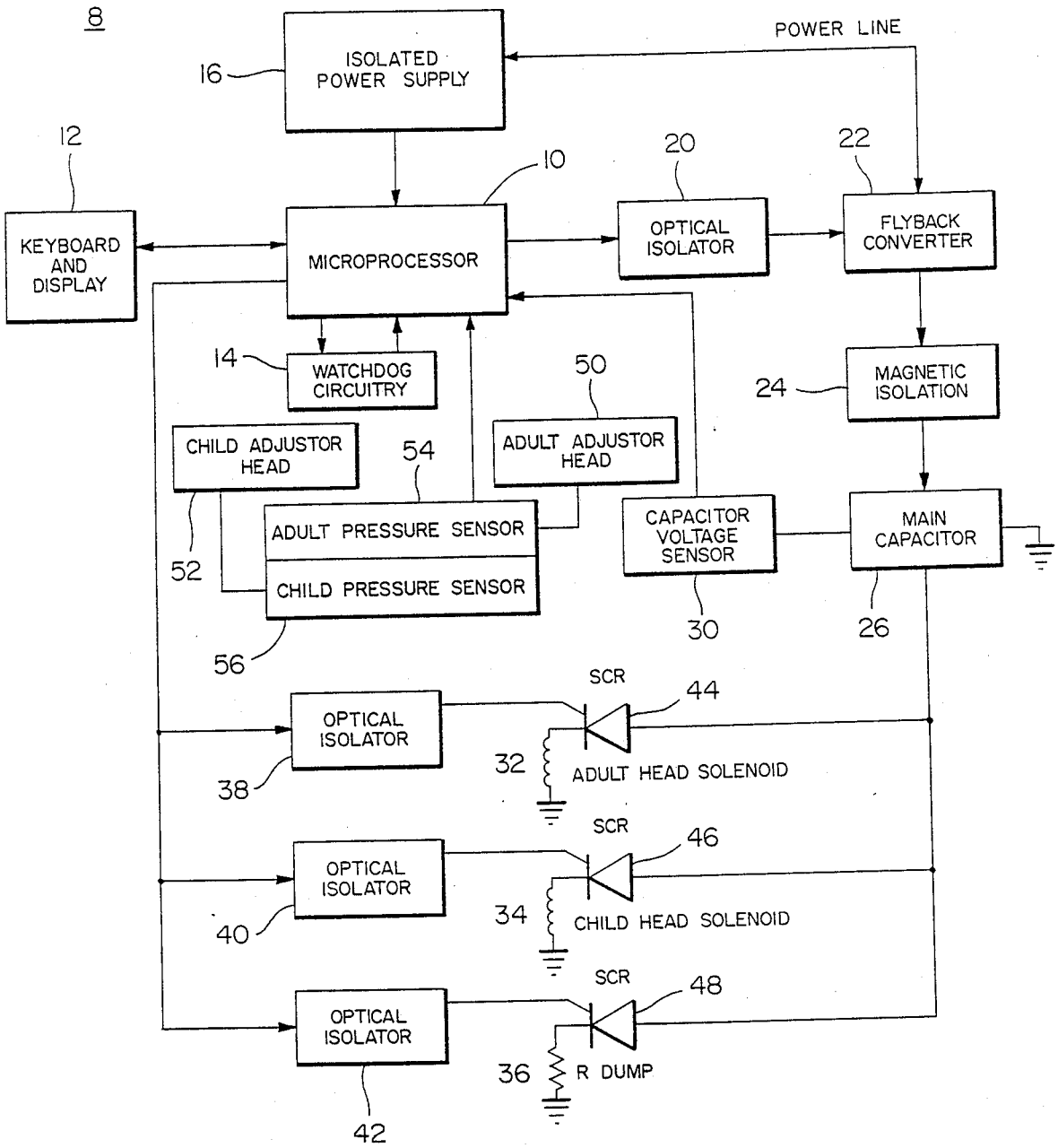
FIG. 1 is a block diagram of a chiropractic adjuster control system of the present invention.

Referring to FIG. 1, the control system 8 is a microprocessor controlled device. The device functions by charging a capacitor 26 to an operator-selected voltage level and discharging the capacitor 26 into a selected solenoid 32 or 34 or a dump resistor 36 when a detected pressure between an adjustment head, of a chiropractic adjuster, and the body of a patient is reached.

The control system of the present invention is used in conjunction with chiropractic adjustor devices such as that disclosed in commonly assigned U.S. Pat. No. 4,841,955 issued June 27, 1989. The disclosure of that application is incorporated by reference herein.

The present invention is described as a system for use with at least one chiropractic adjustor device such as that disclosed in the above-mentioned application. To this end, the solenoid of the adjustor head of the chiropractic adjustor device is electrically connected to the capacitor 26. However, as will become more apparent hereinafter, the control system 8 of the present invention is capable of connecting with two chiropractic adjustor devices, such as, for example, an adult adjustor device and a child adjustor device, selection means is provided in the system 8 for determining the parameters particular to the adjustor device, as well as activation of the chosen adjustor device. In addition, a pressure detector (described hereinafter in detail) is connected to the adjustor head for sensing the pressure applied to the patient therefrom.

The control system 8 includes a keyboard and display 12 for allowing the operator to set and observe the functional parameters of the system. The operator selects or programs the system for the desired energy level to be delivered to the patient by the solenoid 32 or 34. The pressure level between the adjuster head and the patient at which the adjuster head is to be activated by the solenoid is preset according to the energy level selected. A microprocessor 10 is provided which receives input from the keyboard 12. The microprocessor 10 performs all interactions with and timing of the various components of system 8.

A charging circuit 22 in the form of a flyback converter is provided for charging the capacitor 26. The flyback convertor 22 is connected to the microprocessor 10 via an optical isolator 20. The optical isolator 20 provides safety isolation from the flyback converter 22 to the microprocessor 10. A unique feature of this particular flyback converter 22 is that it is not the usual free-running type, but rather can be controlled on a pulse-by-pulse basis by the microprocessor 10. Thus, the pulsing by the microprocessor 10 monitors operation of the flyback converter 22 to prevent "run-away" and over-charge the capacitor 26.

Additionally, the microprocessor 10 monitors the voltage of the capacitor 26 through the capacitor voltage sensor 30 and continuously compensates for the internal leakage of the capacitor 26 by generating additional charge pulses through the circuitry of the optical isolator 20 and the flyback converter 22 to correct the capacitor voltage.

A watch dog circuit 14 is provided to restart the microprocessor 10 in case of a brownout and to detect other failures in the microprocessor 10. The microprocessor 10 times each charge cycle and if it takes longer than three seconds, the microprocessor 10 declares an error condition and prevents firing the capacitor 26 through the solenoids.

The solenoids 32 and 34 and the dump resistor 36 are connected to the microprocessor 10 by respective optical isolators 38, 40, and 42. Associated with the solenoids 32 and 34, and the dump resistor 36 are silicon controlled rectifiers (SCR) 44, 46, and 48, respectively. The solenoids 32 and 34 impart movement to adult and child adjustment heads 50 and 52, respectively, upon receiving energy from the capacitor 26. The dump resistor 36 merely acts as a failsafe for diverting the charge of the capacitor 26 from either solenoid under conditions to be described hereinafter. The pressure of either adjuster head 50 or 52 against the body of a patient is sensed by the respective sensor 54 and 56 and is converted to an electrical signal to be examined by the microprocessor 10.

Figure 2:
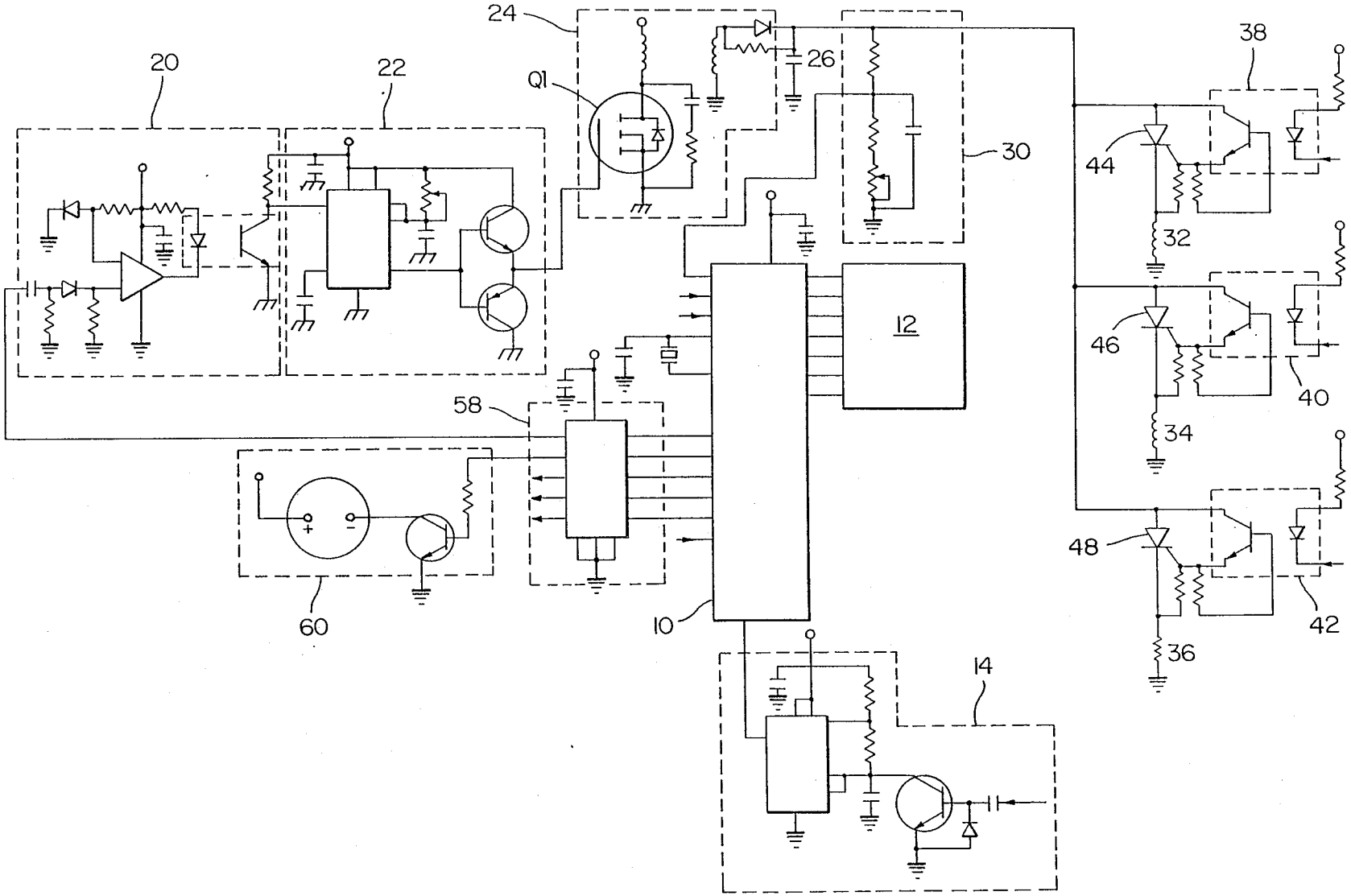
FIG. 2 is an electrical schematic diagram of the system of the present invention.

A detailed schematic diagram of a portion of the control system 8 is illustrated in FIG. 2. A charge pulse for triggering charging of the capacitor 26 from the microprocessor 10 is A.C. coupled to a buffer 58 which turns "ON" the optical isolator circuitry 20. This triggers the one-shot circuitry of the flyback converter 22 to generate a 10 microsecond pulse to turn "ON" transistor Q1 in the magnetic isolator 24. The current in Q1 builds up and stores energy in the magnetic field of the transformer T2 in magnetic isolator 24. The magnetic isolation circuit 24 delivers a fixed amount of energy to capacitor 26, thereby increasing the voltage. This process continues un&:il the processor 10 senses the voltage on the capacitor 26 via the capacitor voltage sensor 30 to be equal to a selected value. The microprocessor 10 then conveys the voltage of the capacitor. 26 to a selected solenoid 32 or 34 when the selected pressure of the corresponding adjustor head 50 or 52 has been sensed by turning on the selected optical isolator 38 or 40.

An audible alarm 60 is provided which is connected to the buffer 58. The buffer 58 is also connected to the optical isolator 42. The microprocessor 10 keeps track of the time period of each charge cycle of the capacitor. If charging takes longer than 3 seconds, the microprocessor 10 senses this error condition and activates the alarm 60. In addition, upon sensing this error condition, the solenoids 32 and 34 are prevented from being energized.

In the event the operator decides to select a different adjustor setting before the discharge of the previously selected setting, the microprocessor 10 senses the new voltage setting, triggers optical isolator 42, and discharges the capacitor 26 internally through dump resistor 36. Thereafter, the control circuitry 8 will recharge the capacitor 26 to the new setting and prevent an inappropriate discharge on the patient.

Figure 3:
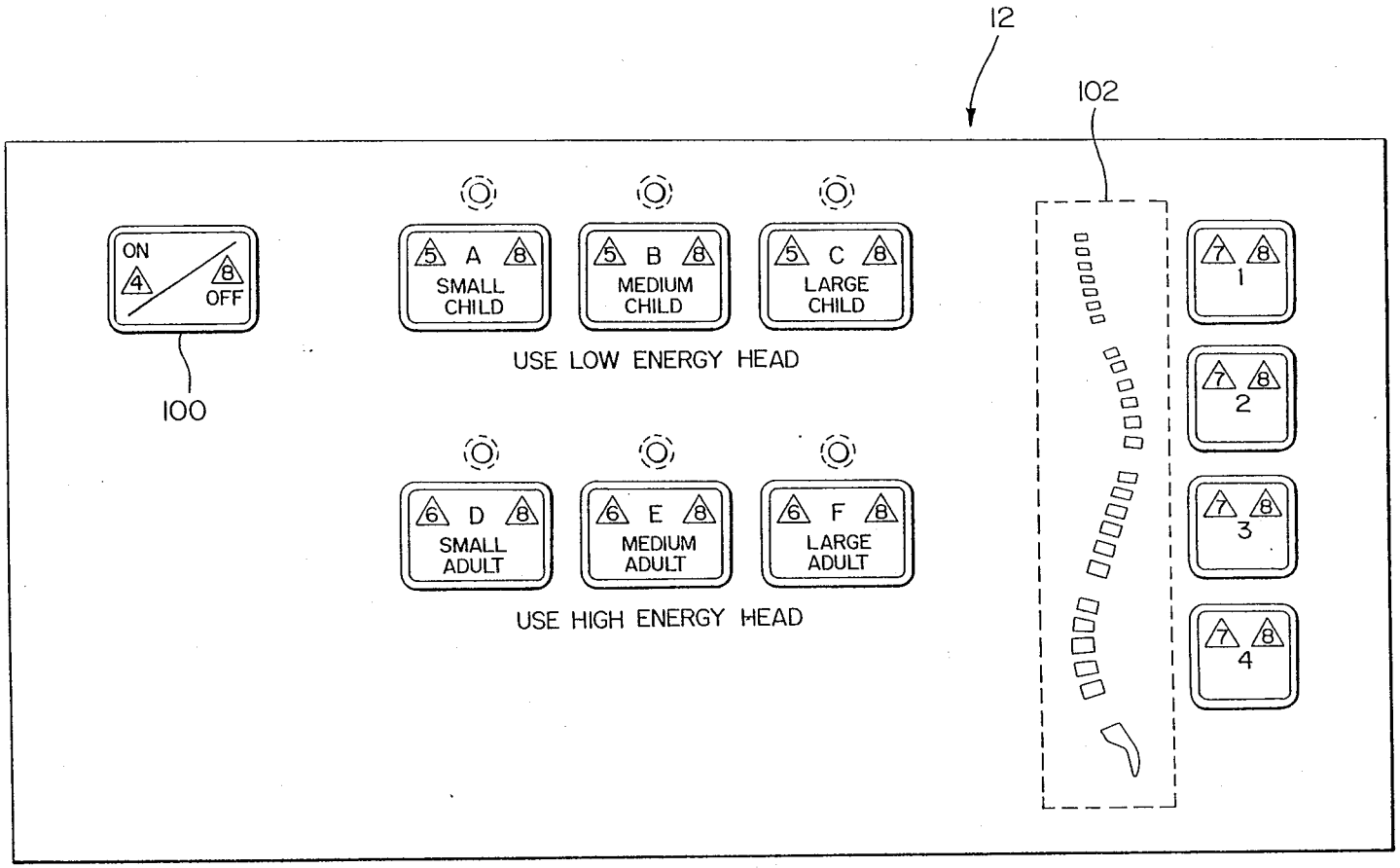
FIG. 3 is a front view of the keyboard and display of the control system of the present invention.

Referring to FIG. 3, the keyboard and display 12 is shown in detail. The system 8 is turned on by the ON/-OFF switch 100. The energy level varies with the type of bone structure of the patient as well as the type of adjustor head employed. Generally, the adult adjustor head 50 is larger and can be driven with higher impact energies than the child adjustor head 52. As such, two sets of energy selection buttons are provided: buttons A, B, and C for a child, and buttons D, E, and F for an adult. The strength of the energy within the respective sets increases from left to right, or alphabetically as shown for patients of varying size. In addition, the energy level selected depends on the position along the spine to which treatment will be provided. To this end, buttons labeled 1-4 are provided along side of an illustration 102 of the spinal segments. The specific energy is thus selected by pressing a combination of two buttons, a letter and a number. By selecting the energy level, the voltage level to which the capacitor will be charged is set, and the threshold pressure between the adjustor head and the patient is also set.

Figure 4:
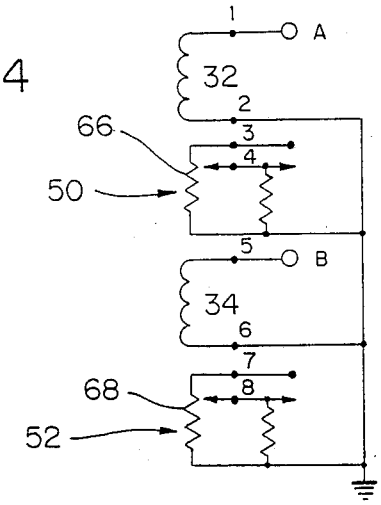
FIG. 4 an electrical schematic diagram of the adjustor head pressure sensor of the system in accordance with the present invention.

FIG. 4 illustrates the electrical circuits of the adjustor head pressure sensors 54 and 56. Each sensor 54 and 56 includes a potentiometer 66 and 68, respectively. As the adjustor head 50 or 52 is pressed against the body of the patient, the wiper arm of the respective potentiometer is displaced to vary the resistance at the output of potentiometer 66 or 68. The resistance affects the level of the signal conveyed to the microprocessor 10 by pins 70 and 72, respectively.

Figure 5:
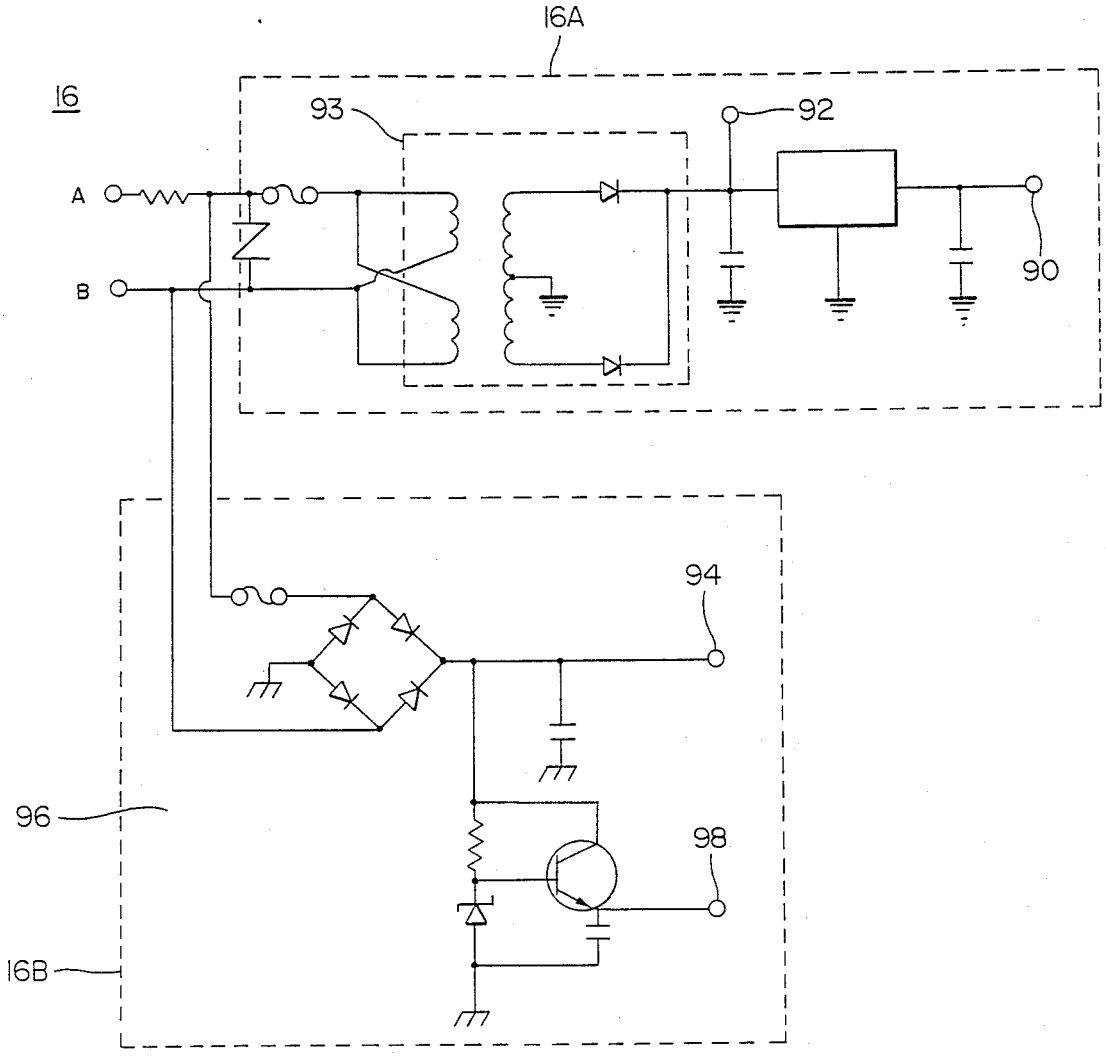
FIG. 5 is an electrical schematic diagram of the power supply of the system in accordance with the present invention.

FIG. 5 illustrates the power supply 16 in greater detail. To provide the necessary power for the circuits of system 8, the power supply 16 comprises two circuit portions 16*a* and 16*b*. Both circuit portions receive as input a conventional 120 A.C. voltage at terminals A-B. However, circuit portion 16*a* provides positive 5 and 10 volts as output at terminals 90 and 92, respectively, via full-wave rectifier 93. Circuit portion 16*b* produces a positive 180 volt supply at terminal 94 via the fullwave rectifier 96. In addition, a 10 volt supply is provided at terminal 98. The 180 volt supply is required by the magnetic isolator 24.

The above description is intended by way of example only, and is not intended to limit the present invention in any way except as set forth in the following claims.

We claim:

1. A system for controlling a chiropractic adjustment instrument including an adjustor head for placement against the body of a patient, said system comprising:

a capacitor means;

a solenoid means connected to said capacitor means and said adjustor head for driving said adjustor head against the body of said patient;

a microprocessor means;

pressure sensing means connected to said microprocessor means for detecting the pressure between said adjustor head and the body of said patient and producing an output signal representative thereof and conveying said output signal to said microprocessor;

a capacitor charging means connected between said microprocessor means and said capacitor means for charging said capacitor means;

a capacitor discharge means for discharging said capacitor into said solenoid means;

a capacitor voltage sensing means connected to said microprocessor means for detecting voltage across said capacitor means and delivering an output signal representative thereof to said microprocessor means; and wherein said microprocessor means triggers said capacitor charging means to charge said capacitor means to a predetermined voltage level monitored by said capacitor voltage sensing means, and whereby said microprocessor triggers said capacitor discharge means to discharge said capacitor means to said solenoid means when said pressure sensing means detects a predetermined pressure level of said adjustor head against the body of said patient.

2. The system of claim 1, wherein said capacitor charging means comprises a flyback converter connected to a magnetic isolator, said flyback converter being triggered by said microprocessor means for generating an electrical pulse, which causes said magnetic isolator to generate a magnetic field storing energy, and delivering said energy to said capacitor means for charging said capacitor means to said predetermined voltage level.

3. The system of claim 1, wherein said pressure sensor means comprises a potentiometer having a wiper arm which is displaced in proportion to the pressure between said adjustor head and the body of said patient.

4. The system of claim 1, and further comprising an alarm means connected to said microprocessor means, said alarm means being activated if said capacitor means is not charged to said predetermined voltage level within a predetermined period of time.

5. The system of claim 1, and further comprising a dump resistor connected to said capacitor means and said microprocessor means, and whereby said capacitor means is discharged through said dump resistor if said predetermined voltage level is an undesired value.

6. The system of claim 1, and further comprising an operator input means connected to said microprocessor means for allowing an operator program at least said predetermined pressure level and said predetermined voltage level.

7. The system of claim 6, and further comprising a display means connected to said microprocessor means for displaying parameters of said system including said predetermined pressure level and predetermined voltage level.

8. A system for controlling a chiropractic adjustment instrument including first and second adjustor heads for placement against the body of a patient, said system comprising:

a capacitor means;

first and second solenoid means connected to said capacitor means and said first and second adjustor heads, respectively, for driving said first and second adjustor heads against the body of said patient;

a microprocessor means;

first and second pressure sensor means connected to said microprocessor means for detecting the pressure of said first and second adjustor heads, respectively, against the body of said patient, and producing respective output signals representative thereof;

a capacitor charging means connected between said microprocessor means and said capacitor means for charging said capacitor means;

a capacitor discharge means for discharging said capacitor to one of said first and second solenoid means;

a capacitor voltage sensing means connected to said microprocessor means for detecting voltage across said capacitor means and delivering an output signal representative thereof to said microprocessor means;

operator input means connected to said microprocessor means for allowing an operator to select one of said first and second adjustor heads to be employed, for programming a predetermined voltage level to which said capacitor means is charged, and for selecting a predetermined pressure between said first and second adjustor heads and the body of said patient; and wherein said microprocessor means triggers said capacitor charging means to charge said capacitor means to said predetermined voltage level, and trigger said capacitor discharge means to discharge said capacitor to one of said first or second solenoid means depending upon which adjustor head is selected by said operator at said operator input means, said microprocessor means triggering said capacitor discharge means when one of said first or second pressure sensing means detects said predetermined pressure between one of said first and second adjustor heads and the body of said patient.

9. The system of claim 8, and further comprising a display means connected to said microprocessor means for displaying parameters of said system including which of said first and second adjustor heads is selected by said operator, said predetermined voltage level, and said predetermined pressure between said first and second adjustor heads and the body of said patient.

10. The system of claim 8, wherein said capacitor charging means comprises a flyback converter connected to a magnetic isolator, said flyback converter being triggered by said microprocessor means for generating an electrical pulse which causes said magnetic isolator to generate a magnetic field storing energy, and delivering said energy to said capacitor means for charging said capacitor means to said predetermined voltage level.

11. The system of claim 8, wherein said pressure sensor means comprises a potentiometer having a wiper arm which is displaced in proportion to the pressure between said adjustor head and the body of said patient.

12. The system of claim 8, and further comprising an alarm means connected to said microprocessor means, said alarm means being activated if said capacitor means is not charged to said predetermined voltage level within a predetermined period of time.

13. The system of claim 8, and further comprising a dump resistor connected to said capacitor means and said microprocessor means, and whereby said capacitor means is discharged through said dump resistor if said predetermined voltage is an undesired value.

* * * * *